US009752450B2

(12) United States Patent
Duguay et al.

(10) Patent No.: US 9,752,450 B2
(45) Date of Patent: Sep. 5, 2017

(54) TURBINE ENGINE TIP CLEARANCE CONTROL SYSTEM WITH LATER TRANSLATABLE SLIDE BLOCK

(71) Applicant: United Technologies Corporation, Hartford, CT (US)

(72) Inventors: Brian Duguay, Berwick, ME (US); Timothy M. Davis, Kennebunk, ME (US)

(73) Assignee: United Technologies Corporation, Farmington, CT (US)

( * ) Notice: Subject to any disclaimer, the term of this patent is extended or adjusted under 35 U.S.C. 154(b) by 98 days.

(21) Appl. No.: 14/731,155

(22) Filed: Jun. 4, 2015

(65) Prior Publication Data

US 2016/0356168 A1 Dec. 8, 2016

(51) Int. Cl.

| | |
|---|---|
| ***F01D 11/22*** | (2006.01) |
| ***F01D 11/14*** | (2006.01) |
| ***F01D 25/24*** | (2006.01) |

(52) U.S. Cl.

CPC ..... *F01D 11/14* (2013.01); *F01D 11/22* (2013.01); *F01D 25/24* (2013.01)

(58) Field of Classification Search

None

See application file for complete search history.

(56) References Cited

U.S. PATENT DOCUMENTS

| | | | | |
|---|---|---|---|---|
| 3,185,441 A | | 5/1965 | Reuter | |
| 5,018,942 A | | 5/1991 | Ciokajlo et al. | |
| 5,035,573 A | * | 7/1991 | Tseng | F01D 11/22 415/126 |
| 5,049,033 A | | 9/1991 | Corsmeier et al. | |
| 5,054,997 A | | 10/1991 | Corsmeier et al. | |
| 5,056,988 A | | 10/1991 | Corsmeier et al. | |
| 5,096,375 A | | 3/1992 | Ciokailo | |
| 5,104,287 A | | 4/1992 | Ciokajlo | |
| 5,228,828 A | | 7/1993 | Damlis et al. | |
| 5,362,202 A | * | 11/1994 | Derouet | F01D 11/22 415/148 |
| 5,545,007 A | | 8/1996 | Martin | |

(Continued)

FOREIGN PATENT DOCUMENTS

| | | |
|---|---|---|
| GB | 2099515 A | 12/1982 |
| WO | WO2009067992 A2 | 6/2009 |
| WO | 2014160953 | 3/2014 |

OTHER PUBLICATIONS

EP search report for EP16163706.1 dated Nov. 18, 2016.
EP search report for EP16163680.8 dated Nov. 18, 2016.
Office action for U.S. Appl. No. 14/731,140 dated Dec. 22, 2016.

*Primary Examiner* — Dwayne J White
*Assistant Examiner* — Theodore Ribadeneyra
(74) *Attorney, Agent, or Firm* — O'Shea Getz P.C.

(57) ABSTRACT

An assembly is provided for a turbine engine with an axial centerline. This turbine engine assembly may include a blade outer air seal segment, a linkage and an actuation device. The linkage may include a shaft and a head, where the shaft is connected to the blade outer air seal segment and extends radially outward to the head. The actuation device may include a sloped slide block located radially within and engaged with the head. The actuation device may be configured to laterally translate the sloped slide block and thereby radially move the blade outer air seal segment.

19 Claims, 8 Drawing Sheets

(56) References Cited

U.S. PATENT DOCUMENTS

| | | | | |
|---|---|---|---|---|
| 8,376,691 | B2 * | 2/2013 | Wulf | F01D 11/22 415/134 |
| 8,434,997 | B2 | 5/2013 | Pinero et al. | |
| 8,734,090 | B2 | 5/2014 | Lewis | |
| 8,934,997 | B2 | 1/2015 | Lambourne | |
| 2006/0013683 | A1 * | 1/2006 | Martindale | F01D 25/24 415/191 |
| 2007/0020095 | A1 | 1/2007 | Dierksmeier et al. | |
| 2012/0063884 | A1 | 3/2012 | Klingels | |
| 2014/0212262 | A1 * | 7/2014 | Harris | F01D 11/22 415/1 |
| 2014/0271147 | A1 * | 9/2014 | Uskert | F01D 11/24 415/173.2 |
| 2015/0218959 | A1 | 8/2015 | Barb et al. | |
| 2016/0265380 | A1 | 9/2016 | Davis et al. | |

* cited by examiner

TURBINE ENGINE TIP CLEARANCE CONTROL SYSTEM WITH LATER TRANSLATABLE SLIDE BLOCK

This invention was made with government support under Contract No. FA8650-09-D-2923 0021 awarded by the United States Air Force. The government may have certain rights in the invention.

BACKGROUND OF THE INVENTION

1. Technical Field

This disclosure relates generally to a turbine engine and, more particularly, to tip clearance control for a turbine engine.

2. Background Information

Various systems are known in the art for controlling clearance between rotor blade tips and a surrounding blade outer air seal (BOAS). Typical active and passive tip clearance control systems react much too slowly to achieve small tip clearances at engine time points of most interest, such as cruise. Those systems also lack the ability to compensate for thermal/mechanical distortions of one or more of the components, further limiting their ability to control tip clearance. Attempts to more-rapidly and precisely position the BOAS, for example through the use of a pneumatically-controlled actuation system, can be very complex and costly.

There is a need in the art for an improved tip clearance control system.

SUMMARY OF THE DISCLOSURE

According to an aspect of the present disclosure, an assembly is provided for a turbine engine with an axial centerline. This turbine engine assembly includes a blade outer air seal segment, a linkage and an actuation device. The linkage includes a shaft and a head. The shaft is connected to the blade outer air seal segment and extends radially outward to the head. The actuation device includes a sloped slide block located radially within and engaged with the head. The actuation device is configured to laterally translate the sloped slide block and thereby radially move the blade outer air seal segment.

According to another aspect of the present disclosure, another assembly is provided for a turbine engine with an axial centerline. This turbine engine assembly includes a blade outer air seal segment, a turbine engine case, a linkage and an actuation device. The turbine engine case circumscribes the blade outer air seal segment. The linkage includes a shaft and a head. The shaft is connected to the blade outer air seal segment and extends radially outward through the turbine engine case to the head. The actuation device includes a base, a sloped slide block and an actuation ann. The base is mounted to the turbine engine case. The sloped slide block is mated with the base. The sloped slide block is slideably engaged with and radially between the base and the head. The actuation arm is pivotally attached to the sloped slide block and pivotally attached to the base. The actuation arm is configured to laterally translate the sloped slide block and thereby move the blade outer air seal segment.

The sloped slide block may be a first sloped slide block. The base may be configured with a second sloped slide block which is engaged with the first sloped slide block.

The sloped slide block may be a first sloped slide block. The head may be configured with a second sloped slide block which is engaged with the first sloped slide block.

The base may include a groove. The sloped slide block may be configured to laterally translate within the groove.

The base may include a second groove. The head may be configured to radially translate within the second groove.

The first groove may extend laterally through the base. The second groove may extend axially through the base.

The assembly may include a second linkage including a second shaft and a second head. The second shaft may extend radially outward through the turbine engine case to the second head. A second actuation device may include a second base and a second sloped slide block. The second base may be mounted to the turbine engine case. The second sloped slide block may be mated with the second base. The second sloped slide block may be slideably engaged with and radially between the second base and the second head. The actuation arm may be pivotally attached to the second sloped slide block. The actuation arm may be configured to laterally translate the second sloped slide block.

The sloped slide block may radially taper as the sloped slide block extends laterally.

The sloped slide block may be a first sloped slide block. The head may be configured with a second sloped slide block which engages the first sloped slide block.

The first sloped slide block may radially taper as the first sloped slide block extends laterally in a first direction. The second sloped slide block may radially taper as the second sloped slide block extends laterally in a second direction.

The actuation device may include a base with a groove. The sloped slide block may be arranged within the groove.

The sloped slide block may be a first sloped slide block. The base may include a second sloped slide block which engages the first sloped slide block.

The first sloped slide block may radially taper as the first sloped slide block extends laterally in a first direction. The second sloped slide block may radially tapers as the second sloped slide block extends laterally in a second direction.

The sloped slide block may be radially engaged between the base and the head.

The actuation device may include an actuation aim pivotally attached to the sloped slide block and pivotally attached to the base. The actuation arm may be configured to laterally translate the sloped slide block.

The assembly may include a second blade outer air seal segment and a second linkage including a second shaft and a second head. The second shaft may be connected to the second blade outer air seal segment and extend radially outward to the second head. A second actuation device may include a second sloped slide block and an actuation arm. The second sloped slide block may be located radially within and engaged with the second head. The second actuation device may be configured to laterally translate the second sloped slide block and thereby move the second blade outer air seal segment. The actuation arm may be pivotally attached to the sloped slide block and pivotally attached to the second sloped slide block. The actuation arm may be configured to laterally translate the sloped slide block and the second sloped slide block.

The assembly may include a turbine engine case. The actuation device may be mounted to an exterior of the turbine engine case. The shaft may extend radially out through an aperture in the turbine engine case to the head.

The linkage may be substantially constrained to radial translation.

The assembly may include a rotor with a plurality of rotor blades. Each of the rotor blades may extend radially outward to a tip. The actuation device may be operable to radially move the blade outer air seal segment to reduce air leakage between the tip and the blade outer air seal segment.

The foregoing features and the operation of the invention will become more apparent in light of the following description and the accompanying drawings.

DETAILED DESCRIPTION OF THE INVENTION

Figure 1:
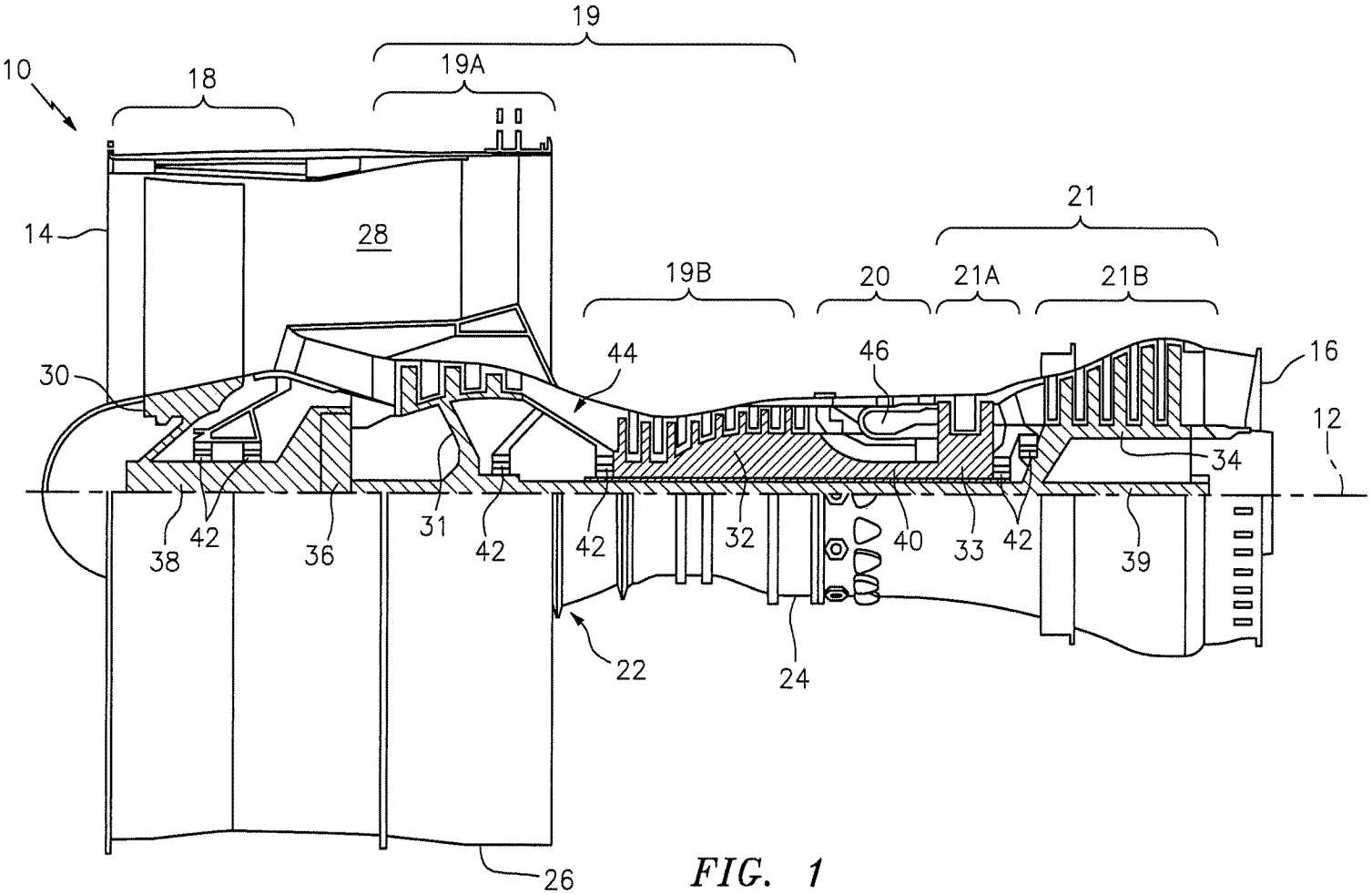
FIG. 1 is a side cutaway illustration of a geared turbine engine.

FIG. 1 is a side cutaway illustration of a geared turbine engine 10. This turbine engine 10 extends along an axial centerline 12 between an upstream airflow inlet 14 and a downstream airflow exhaust 16. The turbine engine 10 includes a fan section 18, a compressor section 19, a combustor section 20 and a turbine section 21. The compressor section 19 includes a low pressure compressor (LPC) section 19A and a high pressure compressor (HPC) section 19B. The turbine section 21 includes a high pressure turbine (HPT) section 21A and a low pressure turbine (LPT) section 21B.

The engine sections 18-21 are arranged sequentially along the centerline 12 within an engine housing 22. This housing 22 includes an inner case 24 (e.g., a core case) and an outer case 26 (e.g., a fan case). The inner case 24 may house one or more of the engine sections 19-21 (e.g., an engine core), and may be housed within an inner nacelle (not shown) which provides an aerodynamic cover for the inner case 24. The inner case 24 may be configured with one or more axial and/or circumferential inner case segments. The outer case 26 may house at least the fan section 18, and may be housed within an outer nacelle (not shown) which provides an aerodynamic cover for the outer case 26. Briefly, the outer nacelle along with the outer case 26 overlaps the inner nacelle thereby defining a bypass gas path 28 radially between the nacelles. The outer case 26 may be configured with one or more axial and/or circumferential outer case segments.

Each of the engine sections 18-19B, 21A and 21B includes a respective rotor 30-34. Each of these rotors 30-34 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 30 is connected to a gear train 36, for example, through a fan shaft 38. The gear train 36 and the LPC rotor 31 are connected to and driven by the LPT rotor 34 through a low speed shaft 39. The HPC rotor 32 is connected to and driven by the HPT rotor 33 through a high speed shaft 40. The shafts 38-40 are rotatably supported by a plurality of bearings 42; e.g., rolling element and/or thrust bearings. Each of these bearings 42 is connected to the engine housing 22 by at least one stationary structure such as, for example, an annular support strut.

During operation, air enters the turbine engine 10 through the airflow inlet 14. This air is directed through the fan section 18 and into a core gas path 44 and the bypass gas path 28. The core gas path 44 extends sequentially through the engine sections 19-21. The air within the core gas path 44 may be referred to as "core air". The air within the bypass gas path 28 may be referred to as "bypass air".

The core air is compressed by the compressor rotors 31 and 32 and directed into a combustion chamber 46 of a combustor in the combustor section 20. Fuel is injected into the combustion chamber 46 and mixed with the compressed core air to provide a fuel-air mixture. This fuel air mixture is ignited and combustion products thereof flow through and sequentially cause the turbine rotors 33 and 34 to rotate. The rotation of the turbine rotors 33 and 34 respectively drive rotation of the compressor rotors 32 and 31 and, thus, compression of the air received from a core airflow inlet. The rotation of the turbine rotor 34 also drives rotation of the fan rotor 30, which propels bypass air through and out of the bypass gas path 28. The propulsion of the bypass air may account for a majority of thrust generated by the turbine engine 10, e.g., more than seventy-five percent (75%) of engine thrust. The turbine engine 10 of the present disclosure, however, is not limited to the foregoing exemplary thrust ratio.

Figure 2:
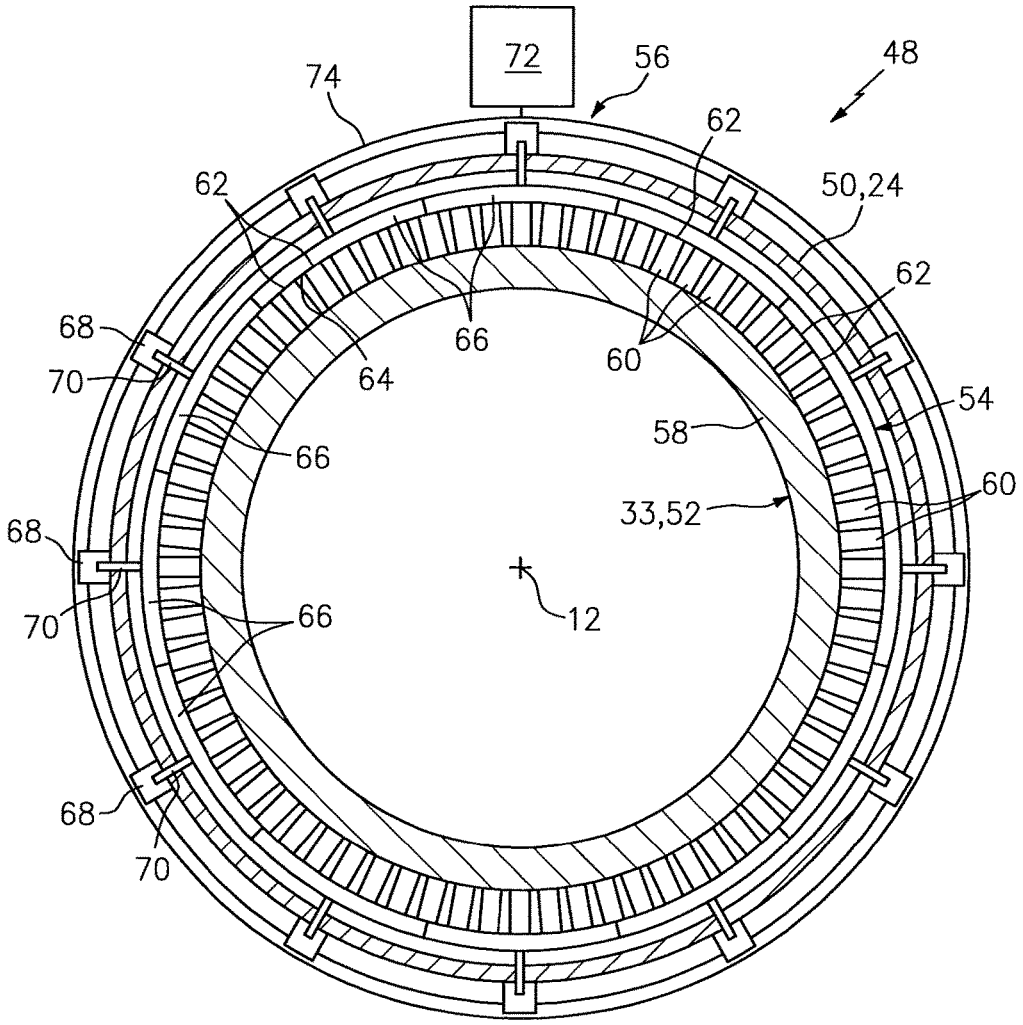
FIG. 2 is an end cutaway illustration of an assembly for the turbine engine.

FIG. 2 illustrates an assembly 48 for the turbine engine 10. This turbine engine assembly 48 includes a turbine engine case 50, a rotor 52, a blade outer air seal 54 ("BOAS") and a tip clearance control system 56. It is worth noting, a blade outer air seal may also be referred to as a shroud.

The turbine engine case 50 may be configured as or part of the inner case 24. The turbine engine case 50, for example, may be configured as an axial tubular segment of the inner case 24 for housing some or all of the HPT rotor 33.

The rotor 52 may be configured as or included in one of the rotors 30-34; e.g., the HPT rotor 33. This rotor 52 includes a rotor disk 58 and a set of rotor blades 60. The rotor blades 60 are arranged circumferentially around and connected to the rotor disk 58. Each of the rotor blades 60 extends radially out from the rotor disk 58 to a respective rotor blade tip 62.

The blade outer air seal 54 circumscribes the rotor 52 and is housed radially within the turbine engine case 50. The blade outer air seal 54 is configured to reduce or eliminate gas leakage across the tips 62 of the rotor blades 60. The blade outer air seal 54 may be configured from or include abradable material. This abradable material, when contacted by one or more of the tips 62 during turbine engine 10 operation, may abrade to prevent damage to those rotor blades 60 as well as enabling provision of little to no gaps radially between the tips 62 and an inner surface 64 of the blade outer air seal 54.

The blade outer air seal 54 includes a plurality of blade outer air seal ("BOAS") segments 66. These BOAS segments 66 are arranged in an annular array about the centerline 12 and the rotor 52. Each of the BOAS segments 66 may have an arcuate geometry that extends partially about the centerline 12 from, for example, about one degree (1°) to about twelve degrees (12°). The present disclosure, however, is not limited to the foregoing exemplary blade outer air seal or BOAS segment configurations. For example, in other embodiments, one or more of the BOAS segments 66 may have an arcuate geometry that extends more than twelve degrees.

The tip clearance control system 56 includes a plurality of actuation devices 68, a plurality of linkages 70 and at least one actuator 72. Here, the actuator 72 is coupled with each of the actuation devices 68 through a rotatable actuation ring 74 which extends circumferentially around the turbine engine case 50. In other embodiments, however, the tip clearance control system 56 may include a plurality of actuators 72 which may each be coupled with a respective one or some of the actuation devices 68.

Figure 3:
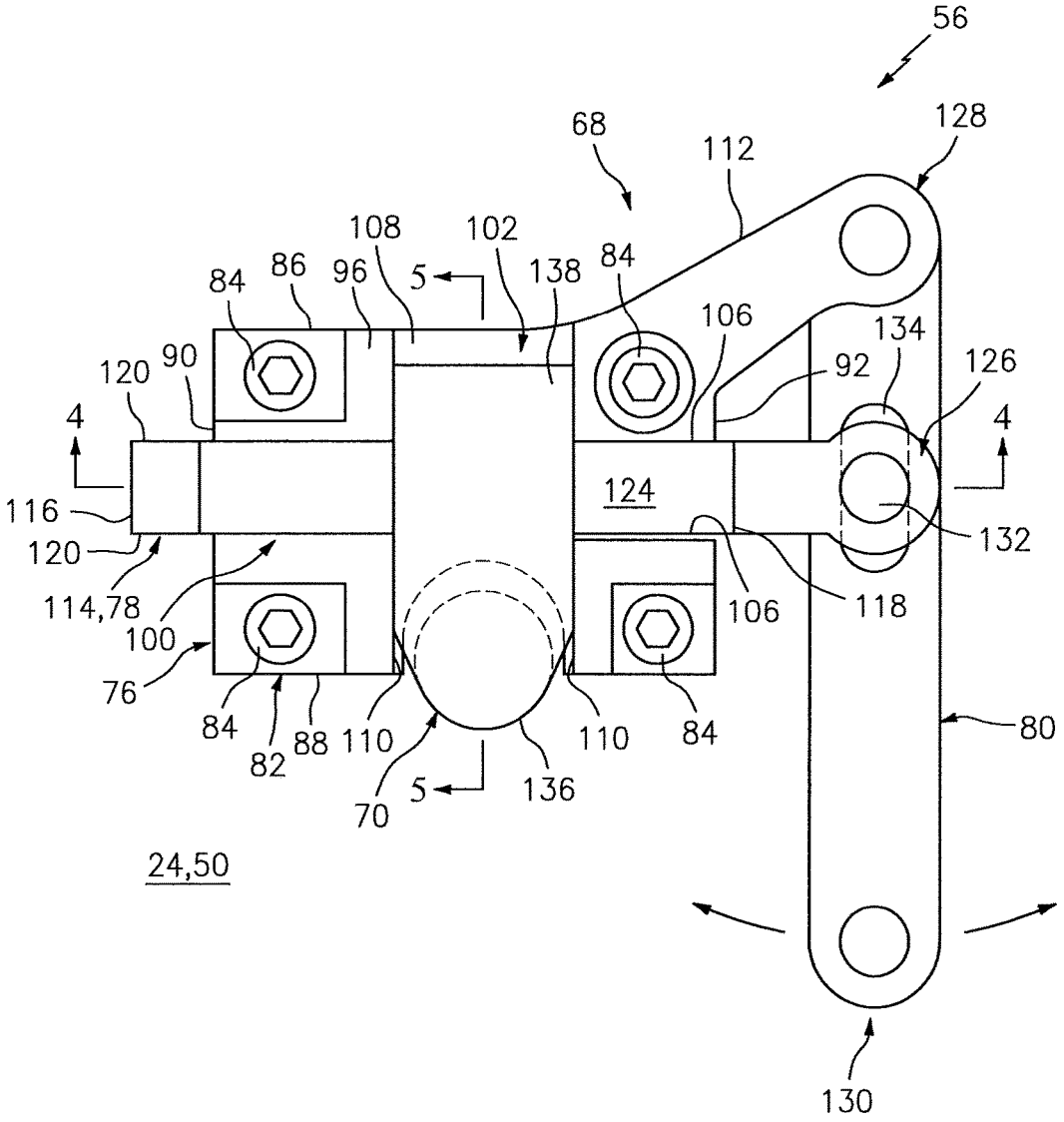
FIG. 3 is a side illustration of a portion of the assembly.
Figure 4:
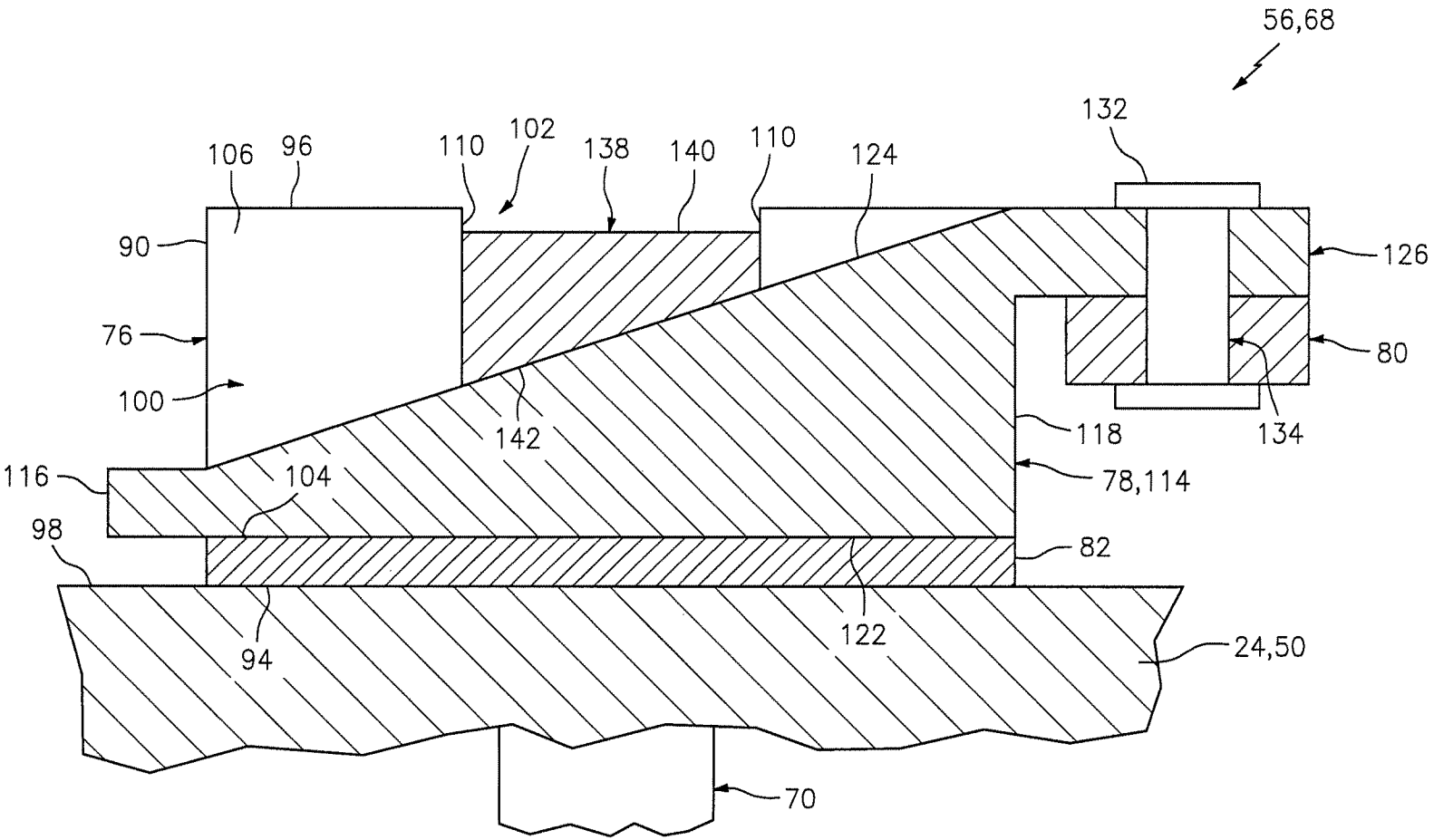
FIG. 4 is an end cutaway illustration of the portion of the assembly of FIG. 3.
Figure 5:
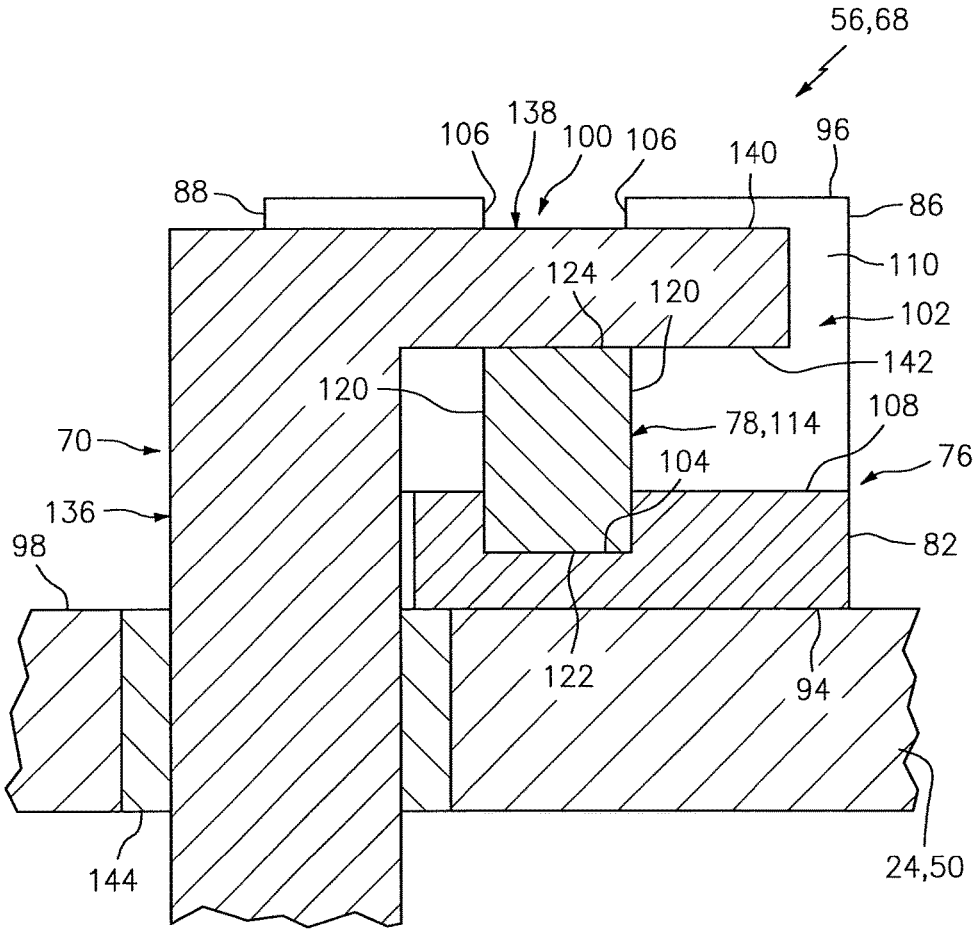
FIG. 5 is a side cutaway illustration of the portion of the assembly of FIG. 3.

Referring to FIG. 3, each of the actuation devices 68 includes a mount 76, a first sloped slide block 78 and an actuation arm 80. The mount 76 includes a base 82 which is connected to the turbine engine case 50. The base 82 of FIG. 3, for example, is mounted to the turbine engine case 50 with one or more fasteners 84; e.g., bolts. The base 82 extends axially (relative to the centerline 12) between a first (e.g., forward) end surface 86 and a second (e.g., aft) end surface 88. The base 82 extends laterally (e.g., circumferentially or tangentially relative to the centerline 12) between a first side surface 90 and a second side surface 92. Referring to FIGS. 4 and 5, the base 82 extends radially between an inner surface 94 and an outer surface 96, which inner surface 94 may radially contact an exterior surface 98 of the turbine engine case 50.

Referring to FIGS. 3-5, the base 82 includes a first groove 100 and a second groove 102, which perpendicularly intersects the first groove 100. The first groove 100 extends radially into the base 82 from the exterior surface 96 to a first groove end surface 104. The first groove 100 extends laterally through the base 82. The first groove 100 extends axially within the base 82 between opposing first groove side surfaces 106. The second groove 102 extends radially into the base 82 from the exterior surface 96 to a second groove end surface 108. The second groove 102 extends axially through the base 82. The second groove 102 extends laterally within the base between opposing second groove side surfaces 110.

Referring to FIG. 3, the mount 76 also includes an arm 112. This aim 112 is connected to (e.g., formed integral with) the base 82 at, for example, a corner between the surfaces 86, 92 and 96. However, the arm 112 may be arranged at another location in other embodiments. Referring again to the embodiment of FIG. 3, the arm 112 extends diagonally (e.g., laterally and/or axially) out from the base 82.

The first sloped slide block 78 include a base 114 which extends laterally between a first end surface 116 and a second end surface 118. The first sloped slide block 78 extends axially between opposing side surfaces 120. Referring to FIGS. 3-5, the first sloped slide block 78 extends radially between a radial inner surface 122 and a radial outer surface 124.

As best seen in FIG. 4, the base 114 has a tapered (e.g., radial) thickness which changes along a lateral width of the base 114. More particularly, one end at the first end surface 116 of the base 114 projects radially beyond the other end at the second end surface 118 of the base 114. In the configuration of FIG. 4, the inner surface 122 is generally non-sloped; e.g., extending along a lateral plane. The outer surface 124, in contrast, extends along a plane that is angularly offset from a lateral plane. The first sloped slide block 78 of the present disclosure, however, is not limited to such a configuration as discussed below in further detail.

The first sloped slide block 78 is slideably mated with the base 82. In particular, the base 114 is arranged within the first groove 100. The inner surface 122 slideably engages (e.g., contacts) the first groove end surface 104. One or more of the side surfaces 120 may respectively slideably engage the first groove side surfaces 106.

The first sloped slide block 78 also includes an arm 126. This arm 126 is connected to (e.g., fanned integral with) the base 114 at, for example, a corner between the surfaces 118 and 124. However, the aim 126 may be arranged at another location in other embodiments. Referring again to the embodiment of FIG. 3, arm 126 is generally radially aligned with the arm 112 but axially offset from the arm 112.

The actuation arm 80 extends longitudinally between a first end 128 and a second end 130. The first end 128 is pivotally attached to a distal end of the arm 112. An intermediate portion of the actuation aim 80 longitudinally between the ends 128 and 130 is pivotally attached to a distal end of the aim 126. In contrast the pivotal attachment between the aims 80 and 112, however, the arms 80 and 126 are also configured to slide relative to one another. For example, a fastener or pin 132 connected to the distal end of the arm 126 extends radially into or through a longitudinally extending slot 134 in the intermediate portion of the actuation arm 80. In this manner, the second end 130 of the actuation arm 80 may be moved along an arc while (e.g., substantially only) laterally translating the first sloped slide block 78 within the mount 76. Note, this second end 130 of the actuation arm 80 may be pivotally attached to the rotatable actuation ring 74 (see FIG. 2) and thereby attached and linked with the actuator 72.

The linkages 70 are arranged in an array circumferentially around the centerline 12 and the blade outer air seal 54. A radial inner end of each of linkages 70 is connected (directly or indirectly) to a respective one of the BOAS segments 66. A radial outer end of each of the linkages 70 is connected to a respective one of the first sloped slide blocks 78. More particularly, the linkage 70 of FIGS. 3-5 includes a shaft 136 and a head 138. The shaft 136 extends radially away from the respective BOAS segment 66, through an aperture in the turbine engine case 50 and a channel in the base 82, and to the head 138.

The head 138 is radially engaged with (e.g., abutted against and contacting) the first sloped slide block 78. In particular, the head 138 may be configured as a second sloped slide block. The head 138 of FIG. 4, for example, has a tapered (e.g., radial) thickness which changes along a lateral width of the head 138. More particularly, one end of the head 138 projects radially beyond the other end of the head 138; however, in an opposite fashion and, thus, tapered in an opposite lateral direction than the first sloped slide block 78. In the configuration of FIG. 4, an outer surface 140 of the head 138 is generally non-sloped; e.g., extending along a lateral plane. An inner surface 142 of the head 138, in contrast, extends along a plane that is angularly offset from a lateral plane. With this configuration, lateral translation of the first sloped slide block 78 will cause the radial translation of the second sloped slide block and, thus, radial translation of the entire linkage 70. The second sloped slide block and thus the head 138 of the present disclosure, however, is not limited to the foregoing exemplary configuration as discussed below in further detail.

The head 138 may be configured to substantially prevent or otherwise limit rotation of the shaft 136 about an axis thereof. A bushing 144 as shown in FIG. 5 may be configured within the aperture and mated with the shaft 136 to substantially prevent or otherwise limit rocking (e.g., lateral and/or axial movement) of the shaft 136. In this manner, the linkage 70 is substantially constrained to radial translation.

The actuator 72 is configured to laterally move (e.g., circumferential rotate) the actuation ring 74 about the centerline 12. The actuator 72 may be configured as, but is not limited to, any type of electrical, hydraulic or other motor.

During turbine engine 10 operation, one or more of the system components may undergo thermal/mechanical distortion; e.g., expand, contract, warp, deflect, etc. The different components may be subject to varying degrees of thermal/mechanical distortion depending upon their proximity to the core gas path 44 and/or secondary flow passages, and unsupported length. To accommodate different degrees of distortion between the components, the tip clearance control system 56 is operated to maintain a minimum (or no) gap between the tips 62 of the rotor blades 60 and the blade outer air seal 54. For example, when a gap between the tips 62 and the blade outer air seal 54 increases, the actuator 72 may rotate the actuation ring 74 clockwise and thereby laterally translate the first sloped slide blocks 78 (towards the right hand side of the FIGS. 3 and 4) and radially move the linkages 70 and the BOAS segments 66 inwards towards the tips 62. Note, typically air pressure between the turbine engine case 50 and the BOAS segments 66 is greater than air pressure within the core gas path 44 which provides a motive force for pushing the BOAS segments 66 radially inward. In another example, when a gap between the tips 62 and the blade outer air seal 54 decreases, the actuator 72 may rotate the actuation ring 74 counter-clockwise and thereby laterally translate the first sloped slide blocks 78 (towards the left hand side of the FIGS. 3 and 4) and radially move the linkages 70 and the BOAS segments 66 outwards away from the tips 62.

The components of the tip clearance control system 56 may also be subject to varying degrees of thermal distortion and, thus, relative movement therebetween. However, such thermal distortion and related movement may not cause the BOAS segments 66 to change position. In particular, thermal distortion and related movement of the tip clearance control system 56 components generally will not cause swinging of the actuation arm 80 or lateral translation of the first sloped slide block 78. The tip clearance control system 56 of the present disclosure therefore may not be subject to varying operability as components thereof are subject to different thermal distortions. In contrast, in prior art systems, such relative movement may also cause movement of attached BOAS segments 66 as described above.

In some embodiments, the slope each of the slide blocks 78 may be substantially the same. In this manner, each of the BOAS segments 66 may move approximately an equal radial distance. In other embodiments, the slope of at least one of the slide blocks 78 may be different than the slope of another one of the slide blocks. In this manner, one or more of the BOAS segments 66 may move a different radial distance than at least one other BOAS segment 66. Such a configuration may be beneficial where the case and/or other components asymmetrically deform during operation. Such asymmetrically deformation may be caused by positioning turbine cooling pipes around the circumference of the turbine engine.

Figure 6:
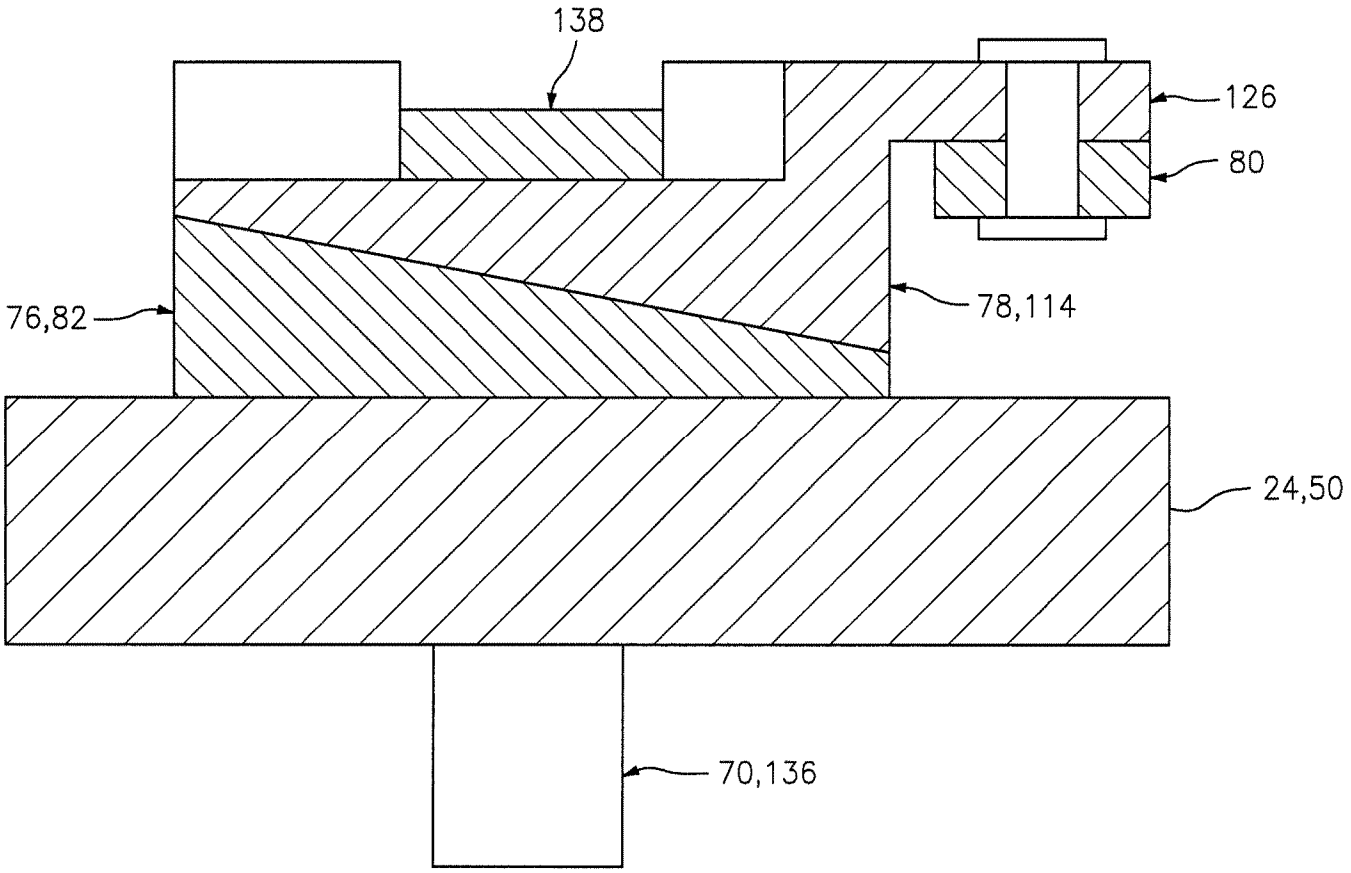
FIG. 6 is an end cutaway illustration of a portion of an alternate assembly for the turbine engine.

In some embodiments, referring to FIG. 6, the base 82 may be configured with a second sloped slide block rather than the head 138.

Figure 7:
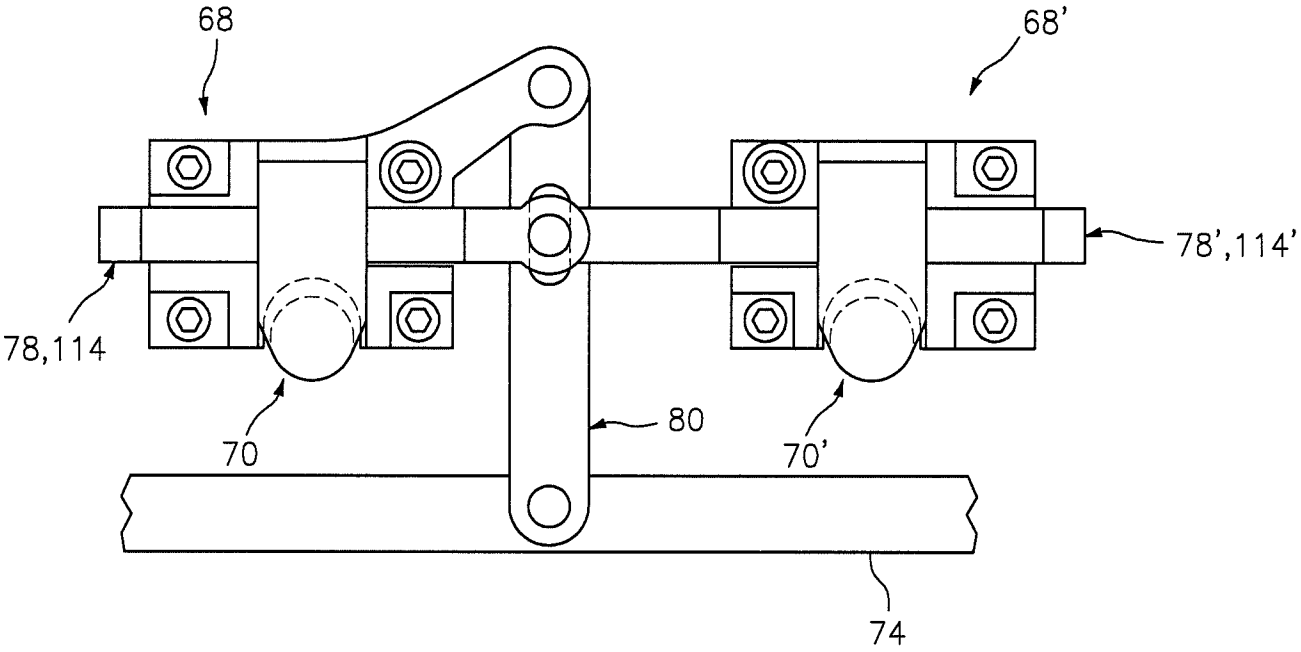
FIG. 7 is a side illustration of a portion of an alternate assembly for the turbine engine.

In some embodiments, referring to FIG. 7, a single actuation arm 80 may be pivotally connected to the first sloped slide blocks 78 and 78' of two adjacent actuation devices 68 and 68'. In such an embodiment, the respective sloped slide blocks 78 and 78' will have opposite configurations such that movement of the actuation arm 80 in in one direction causes radial translation of the respective linkages 70 and 70' in the same direction.

Figure 8:
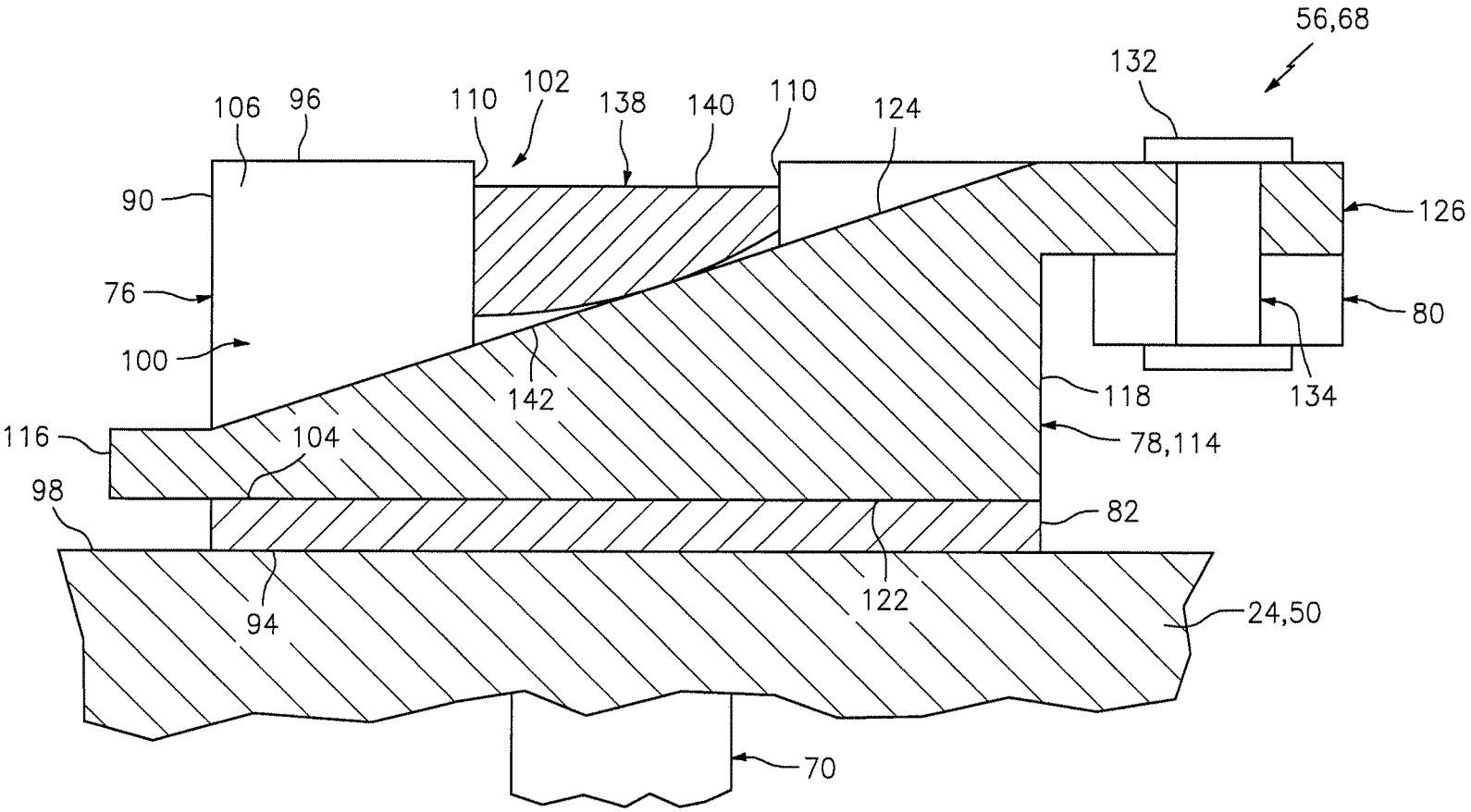
FIG. 8 is an end cutaway illustration of a portion of an alternate assembly for the turbine engine.

In some embodiments, referring to FIG. 8, the inner surface 142 of the head 138 may be arcuate rather than sloped. In this manner, there may be a line contact between the elements 78 and 138 rather than an area contact as shown in FIG. 4.

The BOAS segments 66 described above and illustrated in the drawings are disclosed as being uniquely associated with a single one of the linkages 70 and a single one of the actuation devices 68. However, in other embodiments, one or more of the BOAS segments 66 may be connected to two or more linkages 70 and thus operatively coupled with two or more actuation devices 68.

The turbine engine assembly 48 may be included in various turbine engines other than the one described above. The turbine engine assembly 48, for example, may be included in a geared turbine engine where a gear train connects one or more shafts to one or more rotors in a fan section, a compressor section and/or any other engine section. Alternatively, the turbine engine assembly 48 may be included in a turbine engine configured without a gear train. The turbine engine assembly 48 may be included in a geared or non-geared turbine engine configured with a single spool, with two spools (e.g., see FIG. 1), or with more than two spools. The turbine engine may be configured as a turbofan engine, a turbojet engine, a propfan engine, a pusher fan engine or any other type of turbine engine. It is also worth noting the turbine engine assembly 48 may be included in turbine engines other than those configured for an aircraft (e.g., airplane or helicopter) propulsion system. The turbine engine assembly 48, for example, may be configured for an industrial gas turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

What is claimed is:

1. An assembly for a turbine engine with an axial centerline, comprising:

a blade outer air seal segment;

a linkage including a shaft and a head, the shaft connected to the blade outer air seal segment and extending radially outward to the head; and an actuation device including a sloped slide block located radially within and engaged with the head, the actuation device configured to laterally translate the sloped slide block and thereby radially move the blade outer air seal segment;

wherein the sloped slide block radially tapers as the sloped slide block extends laterally.

2. The assembly of claim 1, wherein the actuation device further includes a base with a groove, and the sloped slide block is arranged within the groove.

3. The assembly of claim 2, wherein the sloped slide block is radially engaged between the base and the head.

4. The assembly of claim 1, further comprising a turbine engine case, wherein the actuation device is mounted to an exterior of the turbine engine case, and the shaft extends radially out through an aperture in the turbine engine case to the head.

5. The assembly of claim 1, wherein the linkage is substantially constrained to radial translation.

6. The assembly of claim 1, further comprising a rotor with a plurality of rotor blades, wherein each of the rotor blades extends radially outward to a tip, and the actuation device is operable to radially move the blade outer air seal segment to reduce air leakage between the tip and the blade outer air seal segment.

7. An assembly for a turbine engine with an axial centerline, comprising:

a blade outer air seal segment;

a linkage including a shaft and a head, the shaft connected to the blade outer air seal segment and extending radially outward to the head; and an actuation device including a sloped slide block located radially within and engaged with the head, the actuation device configured to laterally translate the sloped slide block and thereby radially move the blade outer air seal segment;

wherein the sloped slide block is a first sloped slide block, and the head is configured with a second sloped slide block which engages the first sloped slide block.

8. The assembly of claim 7, wherein the first sloped slide block radially tapers as the first sloped slide block extends laterally in a first direction, and the second sloped slide block radially tapers as the second sloped slide block extends laterally in a second direction.

9. An assembly for a turbine engine with an axial centerline, comprising:

a blade outer air seal segment;

a linkage including a shaft and a head, the shaft connected to the blade outer air seal segment and extending radially outward to the head; and an actuation device including a sloped slide block located radially within and engaged with the head, the actuation device configured to laterally translate the sloped slide block and thereby radially move the blade outer air seal segment;

wherein the actuation device further includes a base with a groove, and the sloped slide block is arranged within the groove; and wherein the sloped slide block is a first sloped slide block, and the base includes a second sloped slide block which engages the first sloped slide block.

10. The assembly of claim 9, wherein the first sloped slide block radially tapers as the first sloped slide block extends laterally in a first direction, and the second sloped slide block radially tapers as the second sloped slide block extends laterally in a second direction.

11. An assembly for a turbine engine with an axial centerline, comprising:

a blade outer air seal segment;

a linkage including a shaft and a head, the shaft connected to the blade outer air seal segment and extending radially outward to the head; and an actuation device including a sloped slide block located radially within and engaged with the head, the actuation device configured to laterally translate the sloped slide block and thereby radially move the blade outer air seal segment;

wherein the actuation device further includes a base with a groove, and the sloped slide block is arranged within the groove; and wherein the actuation device further includes an actuation arm pivotally attached to the sloped slide block and pivotally attached to the base, and the actuation arm is configured to laterally translate the sloped slide block.

12. An assembly for a turbine engine with an axial centerline, comprising:

a blade outer air seal segment;

a linkage including a shaft and a head, the shaft connected to the blade outer air seal segment and extending radially outward to the head;

an actuation device including a sloped slide block located radially within and engaged with the head, the actuation device configured to laterally translate the sloped slide block and thereby radially move the blade outer air seal segment;

a second blade outer air seal segment;

a second linkage including a second shaft and a second head, the second shaft connected to the second blade outer air seal segment and extending radially outward to the second head; and a second actuation device including a second sloped slide block and an actuation arm, the second sloped slide block is located radially within and engaged with the second head, the second actuation device configured to laterally translate the second sloped slide block and thereby move the second blade outer air seal segment;

wherein the actuation arm is pivotally attached to the sloped slide block and pivotally attached to the second sloped slide block, and the actuation arm is configured to laterally translate the sloped slide block and the second sloped slide block.

13. An assembly for a turbine engine with an axial centerline, comprising:

a blade outer air seal segment;

a turbine engine case circumscribing the blade outer air seal segment;

a linkage including a shaft and a head, the shaft connected to the blade outer air seal segment and extending radially outward through the turbine engine case to the head; and an actuation device including a base, a sloped slide block and an actuation aim;

the base mounted to the turbine engine case;

the sloped slide block mated with the base, and the sloped slide block slideably engaged with and radially between the base and the head; and the actuation arm pivotally attached to the sloped slide block and pivotally attached to the base, and the actuation arm is configured to laterally translate the sloped slide block and thereby move the blade outer air seal segment.

14. The assembly of claim 13, wherein the sloped slide block is a first sloped slide block, and the base is configured with a second sloped slide block which is engaged with the first sloped slide block.

15. The assembly of claim 13, wherein the sloped slide block is a first sloped slide block, and the head is configured with a second sloped slide block which is engaged with the first sloped slide block.

16. The assembly of claim 13, wherein the base includes a groove, and the sloped slide block is configured to laterally translate within the groove.

17. The assembly of claim 16, wherein the base further includes a second groove, and the head is configured to radially translate within the second groove.

18. The assembly of claim 17, wherein the first groove extends laterally through the base and the second groove extends axially through the base.

19. The assembly of claim 13, further comprising:

a second linkage including a second shaft and a second head, the second shaft extending radially outward through the turbine engine case to the second head; and a second actuation device including a second base and a second sloped slide block;

the second base mounted to the turbine engine case;

the second sloped slide block mated with the second base, and the second sloped slide block slideably engaged with and radially between the second base and the second head; and the actuation arm pivotally attached to the second sloped slide block, and the actuation arm further configured to laterally translate the second sloped slide block.

* * * * *